United States Patent [19]

Schippers et al.

[11] 3,945,579

[45] Mar. 23, 1976

[54] WINDING MECHANISMS WITH FRICTION DRIVE ROLLERS

[75] Inventors: Heinz Schippers; Erich Lenk, both of Remscheid, Germany

[73] Assignee: Barmag Barmer Maschinenfabrik Aktiengesellschaft, Wuppertal, Germany

[22] Filed: May 31, 1974

[21] Appl. No.: 474,898

[30] Foreign Application Priority Data

June 7, 1973 Germany ..... 2328993

[52] U.S. Cl. ..... 242/18 DD; 74/191; 242/18 CS; 242/37 R; 242/45

[51] Int. Cl.[2] ..... B65H 54/42; B65H 63/02

[58] Field of Search ..... 242/18 DD, 18 R, 18 CS, 242/45, 36, 37 R; 74/190, 191

[56] References Cited

UNITED STATES PATENTS

| | | | |
|---|---|---|---|
| 898,327 | 9/1908 | Couch | 74/191 |
| 1,182,778 | 5/1916 | Leaming | 74/191 |
| 1,935,931 | 11/1933 | Baumert et al. | 242/18 CS UX |
| 2,168,956 | 8/1939 | Kohl | 74/191 X |
| 3,563,480 | 2/1971 | Crouzet | 242/18 DD X |
| 3,565,356 | 2/1971 | Marbacher et al. | 242/18 DD |

FOREIGN PATENTS OR APPLICATIONS

| | | | |
|---|---|---|---|
| 669,756 | 1/1939 | Germany | 74/191 |
| 289,894 | 6/1965 | Netherlands | 242/18 DD |
| 89,028 | 4/1937 | Sweden | 74/191 |

*Primary Examiner*—Stanley N. Gilreath
*Attorney, Agent, or Firm*—Johnston, Keil, Thompson & Shurtleff

[57] ABSTRACT

A winding mechanism with a friction drive roller for driving the winding package; at least one peripherally tapered, friction drive wheel inside the friction drive roller for rotatably driving same at variable speeds, the variation of which is obtained by axial shifting of the friction drive roller and its support; cam control means for attaining the axial shifting with increasing diameter of the winding; and the friction drive inside the roller being disengageable upon movement of the roller at right angles to its axis of rotation.

11 Claims, 8 Drawing Figures

$V_F$
$V_{CH}$
$V_U$
$V_Z$
a
1
2
2'
2"
3
4
5
6
6a
6b
7
8
9
10
10'
10"
10a
11
11a
13
14
14'
20
20'
23
24
25
26
27
28
29
30
31
34
35
36

WINDING MECHANISMS WITH FRICTION DRIVE ROLLERS

Known winding arrangements utilize a projecting or U-shaped bobbin holder (e.g., German published patent application OS 2,106,493). The bobbin holder rotatably supports a winding package, i.e., a winding tube and the winding formed thereon. The winding tube and said winding are driven by a friction drive roller. The bobbin holder and the drive roller move relative to one another with the diameter increase of the winding formed on the winding tube.

The drive roller is ordinarily driven at a constant speed. Its circumferential speed is attuned to the constant thread feed rate. The thread conveying devices preceding the winding mechanism, e.g., godets, are connected to the winding mechanism via a regulating device, gear trains, etc. to maintain one or more predetermined ratios of rate of feed of the thread to rate of take up of the thread on the winding package.

In today's technology, it has been found to be desirable to vary the circumferential speed of the friction drive roller, which determines the rate of take up of the thread on the winding package, within certain limits during the course of the winding. This is desirable in the case of certain threads with low elasticity, or even necessary, in order to deposit the thread with constant thread tension in the course of the bobbin journey or at least to deposit it with a prescribed course of thread tension and/or to produce bobbin windings with uniform hardness. How the drive roller circumferential speed is to be varied in individual instances has to be determined by experiment. This determination lies within the scope of the ability of an average worker in the field.

Through the variation of the drive roller circumferential speed independently of the constant thread delivery speed it is also possible, in the case of variable traverse speed, to influence the thread winding speed, which is of importance in the production of cylindrical windings within conical or biconical ends. For the production of biconical windings there are used traverse systems with reverse-thread shaft and traverse thread guides. The reverse-thread shafts are driven at a constant speed in a prescribed translation ratio to the drive of the drive roller and of the pre-engaged conveying arrangements. The stroke reduction in the course of the bobbin journey has the consequence now that the traverse speed decreases with constant numbers of traverse strokes per time unit. From this there is yielded, with constant circumferential speed of the bobbin, a reduction of the thread winding speed according to the formula $$V_F = \sqrt{V^2_u + V^2\text{ch}}, \text{ where}$$

$V_F$ is the threading winding speed $V_{ch}$ is the transverse speed $V_u$ is the circumferential speed of the drive roller.

In the production of biconical windings, therefore, for the maintaining constant of the thread winding speed with traverse speed becoming smaller, the circumferential speed of the drive roller must increase.

The varying of the drive roller circumferential velocity can be achieved in an obvious manner by varying the rotational speed of the drive roller drive. If, however, several drive rollers are fixedly mounted on a shaft, then the collective shifting of the drive roller drive speed is disadvantageous since it permits no adaptation of the drive roller circumferential speed to the individual working places and to the particular stage of the bobbin winding.

The object of the invention, therefore, is the providing of a drive connection between the roller drive shaft driven at a constant rate and the drive roller, which permits the individual adjustment of the turning speed of each drive roller.

The invention herein pertains to winding mechanisms having a friction drive roller rotatably journalled for rotation relative to the drive shaft for said drive roller. The drive roller is rotatably journalled on a drive roller holder which is shiftable in the axial direction of the drive roller and also perpendicularly to the drive roller in a radial direction. The drive roller is driven by the drive shaft through one or more friction wheel couplings including at least one tapered friction wheel or gear. The friction drive roller has a ring-like friction drive wheel or gear which rests or bears upon a friction drive wheel or gear mounted on and rotatable with the drive shaft. The friction wheel pair is engaged and disengaged by movement of the drive roller and its holder perpendicular to the axis of rotation of the drive roller and in a radial direction of the drive roller. The rate of rotational drive of the drive roller is adjustable by axial displacement of the drive roller and its holder to bring into engagement in each friction wheel pairing segments of different diameter of a tapered surface on one or both wheels of each friction wheel pair.

A special advantage of the invention is that the drive roller can be set in operation and stopped and varied in its circumferential speed, without there being necessary for this a shifting or switching of the collective drive roller drive gear and, in particular, of the drive shaft. The variation of the circumferential speed of the drive roller takes place, therefore, according to this invention, through axial displacement of the drive roller holder and the coupling and uncoupling is accomplished through movement of the drive roller holder perpendicularly to the drive roller axis, i.e., in radial direction.

In thread processing operations, dust, or airborne solids, preparation and finishing sprays applied to the threads, etc. are a source of fouling of textile machine parts. Such airborne substances are particularly detrimental in friction drive gear connections. For this reason, the aforesaid friction wheel pairs are located in the interior of the drive roller where they are less susceptible to fouling by airborne substances. One of the friction wheels or gears is a annular wheel attached to the inside of the friction drive roller and coaxial therewith. The other friction wheel is preferably a tapered wheel or gear coaxially mounted on the drive shaft, which extends through the friction drive roller.

The axial shifting of the drive roller holder to vary the circumferential speed of the drive roller can be carried out by hand or in dependence on operating parameters of a programming or a time control. One form of such control utilizes a control cam operatively associated with the bobbin holder, e.g., mounted thereon, in a manner whereby the control cam mechanism shifts the drive roller holder in the axial direction of the drive roller in direct dependence upon the distance between the drive roller axis and the winding tube axis, which distance changes as the winding diameter increases. Preferably, the winding mechanism includes a plurality of exchangeable control cams having camming surfaces of different curvatures, each suited for a particular winding operation.

A special advantage of these control cam combinations is that the rotational speed of the drive roller at each individual winding station is controlled in dependence upon the particular stage of the winding and type of winding according to the predetermined program imparted by the particular cam surface. Hence, a plurality of friction drive rollers can be driven off the same drive shaft with different drive speeds imparted to the individual drive rollers at the various winding stations in accord with the particular state of the winding at each station.

In order to obtain a constant thread winding speed in the production of biconical windings—for example with the aid of a winding and traverse system according to German published patent application OS 1,916,580—a steady rise of the control cam in the sense that the drive speed ratio of drive roller to drive shaft increases continuously in the course of the bobbin journey is demanded. In the winding of bobbins with a constant hardness of the winding or other predetermined hardness pattern, a cam having the crown of the curved cam surface intermediate the ends of the cam surface path is advantageous. By use of such cam surface, the axial position of the drive roller is moved in such a way that the relative speed of rotation of the drive roller to the drive shaft first increases and then decreases in the course of the formation of the winding package.

In order to reduce the wearing down of the proposed drive roller drive with use of inner friction wheels, it is suggested that the friction wheels of the bevel wheel pairing have equal diameter in an axial end position of the drive roller holder. This creates an axial position of the drive roller which should be maintained when no change of the translation ratio between driving roller and drive roller is desired in the course of the bobbin journey. In this axial position of the drive roller, outer and inner friction wheels are in contact with one another over their entire periphery, and no wear between them occurs.

A special advantage of the invention—as mentioned—lies also in that each individual drive roller can be brought to a stop without its being necessary to halt the collective drive of the drive roller shaft and the thread conveying arrangements. For this, the drive roller holder is movable by sliding into an axial end position to shift the drive roller radial direction, so that the friction wheel pairing loses contact. Obviously, the drive roller holder could be moved also merely in radial direction to stop the drive roller. The aforesaid combination, however, offers the advantage that only one device for the axial shifting of the drive roller holder is needed and that only low forces are required for lifting the drive roller holder when the drive roller holder, for example, is lifted by an inclined plane.

The aforesaid axial shifting of the drive roller and its holder can be actuated by a thread monitoring device or control. Such device or control may embody an electric circuit operable by a thread tension feeler to energize an electromagnet which shifts the drive roller and its holder and drive roller in an axial direction if thread breakage should occur. The axial shifting by the electromagnet shifts the drive roller holder onto the inclined plane to disengage the friction drive wheels or gears.

The embodiments of the invention hereinafter described with reference to the drawings constitute preferred embodiments of winding mechanisms used for the winding of threads, yarns, filaments, etc., herein referred to collectively as threads. The mechanism may be used for winding devices of other types of machines, e.g., for the winding of fabrics, foils, webs, bands, etc. wherein such machines have several winding stations utilizing a collective drive for the various drive rollers or where there is an advantage in using a variable drive roller speed.

The preferred embodiments utilize the feature of encasement or housing of the driving wheels or gears within the drive rollers. The bearing support for the drive roller can also be taken over solely by the drive shaft or the friction wheels or gears, as is analogously shown in German Pat. No. 652,407. The drive roller holder serves then merely for the axial shifting and the radial movement of the drive roller. If the arrangement of the friction wheels or gears is not in the interior of the drive roller, the drive roller can be supported parallel to and beside the drive shaft with the friction wheels or gears located exteriorly of the drive roller.

Referring to the drawings:

FIG. 1 is a front perspective view of a winding mechanism at one winding station of a thread winding machine;

FIG. 1*a* is a vector diagram of the thread velocities for the winding mechanism of FIG. 1;

Figures 1, 1A:
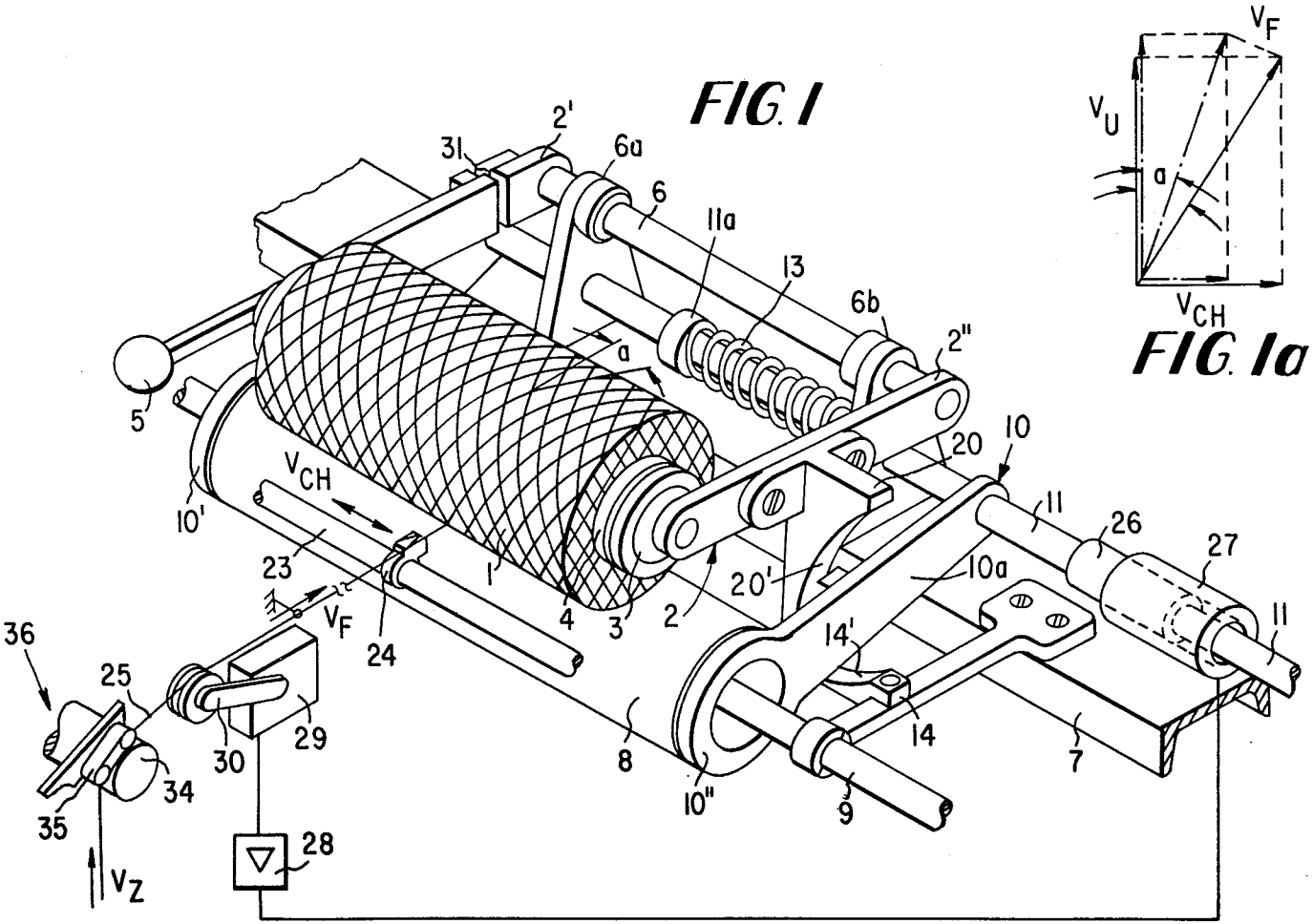
Figure 2:
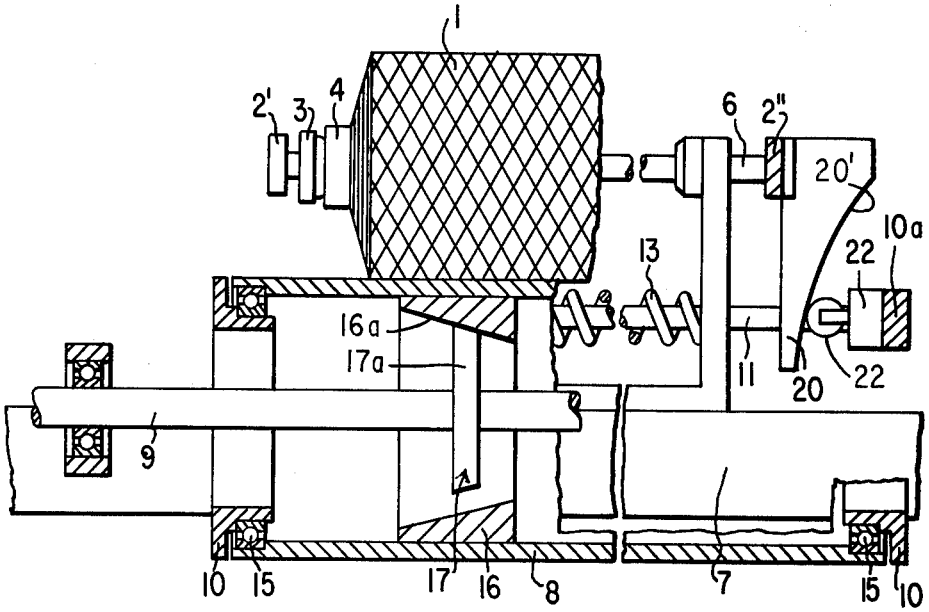
FIG. 2 is a front, fragmentary, partially sectioned, detail view of the embodiment of FIG. 1.
Figure 4:
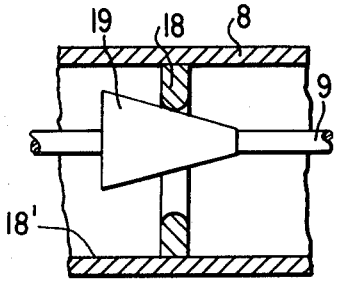
FIG. 4 is a fragmentary, section view of an alternative embodiment of a friction drive wheel pair.
Figure 6A:
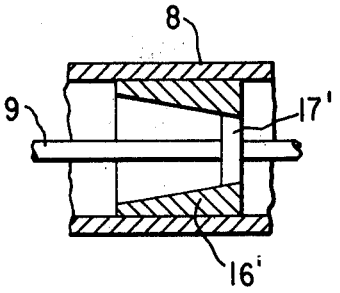
Figure 6B:
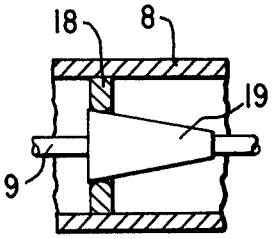

FIG. 6*a* is a fragmentary, diametric section of the friction wheel drive of the embodiment of FIGS. 1 and 2 with the friction drive wheels in a 1:1 drive ratio position; and FIG. 6*b* is a fragmentary, diametric section of the friction wheel drive of the embodiment of FIG. 4 with the friction drive wheels in a 1:1 drive ratio position.

FIG. 1 shows the bobbin winding 1, which is driven by the drive roller 8. The bobbin 1 is journalled on the bobbin holder. The bobbin holder is a pivotable U-shaped bracket 2 consisting of two arms 2' and 2'' mounted on the shaft 6, which is rotatable in bearings 6*a*, 6*b*. At the ends of the arms 2', 2'' there are rotatable, bobbin-holding discs 3. Further, the arm 2', which has the handle 5, is swingable perpendicular to the shaft 6 about the pin axle 31. The arm 2' is spring-biased to pivot toward its end of the bobbin. In this construction of the bobbin holder there can be clamped between the rotatable discs 3 a winding tube 4. The tube and thereafter the winding formed thereon are driven by frictional contact with the drive roller 8.

The drive roller 8 is journalled to turn freely in a drive roller holder 10. The drive roller holder consists of a U-shaped arrangement of two arms 10', 10'' which are mounted on the shaft 11 in a manner whereby they are pivotable with the shaft 11 and are reciprocable with shaft 11 when it is moved axially. The drive roller holder is pressed to the left (FIG. 1) by the coil spring 13 mounted about the shaft 11 and compressed between the fixed sleeve 11a and the support arm for bearing 6b.

The thread is supplied at a constant thread delivery rate by the belt delivery mechanism 36, which consists of the roll 34 driven at a constant rate of rotation and the contactpressure belt 35 riding on and driven by the roll 34. The thread is reciprocated by the traverse thread guide 24 over the traverse stroke range. For the production of biconic windings there is used a traverse thread guide, such as is described, for example, in German published Pat. application OS 1,916,580. The thread guide 24 should touch neither the drive roller 8 nor the bobbin 1 when the drive roller is lifted or lowered. For this reason, the thread guide 24 can be connected, through a mechanism not illustrated, with the drive roller holder 10 so that the guide pivots about the traverse rod 23 or is raised or lowered with a correspondingly articulated traverse rod 23.

FIG. 1a shows the vector diagram of the respective velocities for the winding process, the symbols of which also appear in FIG. 1. The thread winding speed, which must correspond essentially to the constant thread feed rate $V_Z$, is designated with $V_F$. $V_F$ is the geometrical sum of the drive roller circumferential velocity $V_u$ and of the traverse velocity $V_{ch}$. In the production of biconic windings the circumferential velocity decreases in the course of the bobbin journey. For this reason, the drive roller circumferential velocity $V_u$ has to increase in the course of the bobbin journey according to the formula $$V_F = \sqrt{V_u^2 + V_{ch}^2}$$

and from the geometric relations to be seen from FIG. 1a, so that $V_F$ remains constant and substantially equal to $V_z$. The vectors $V_u$ and $V_F$ enclose between them the displacement angle d, which is also represented in FIG. 1 as angle between the thread and the tangent lying in the normal plane.

FIG. 2, a section view of the embodiment of FIG. 1, shows in particular the drive connection between the driving shaft 9 and the drive roller 8. The hollow drive roller 8 has an internal, driven wheel 16 with a frusto-conical inner wall 16a. This annular wheel 16 is in friction contact with the friction drive wheel 17 of the drive shaft 9. The periphery 17a of the wheel 17 has a peripherally tapered configuration and preferably is frusto-conical with a taper approximating the taper of wall 16a. The diameter of the larger face of the friction wheel 17 is at least as great as the smallest diameter of the frusto-conical wall 16a of the wheel 16. Through axial shifting of the drive roller holder 10, in which the drive roller is journalled on both ends in the bearings 15, the drive output ratio or translation ratio between drive roller 8 and drive shaft 9 is variable in stageless increments.

FIGS. 1 and 2 show structures by which the translation ratio between drive roller 8 and drive shaft 9 can be controlled in dependence on the increasing bobbin diameter. The bobbin holder carries on arm 2'' a control cam 20. The curved, cam surface 20' is engaged by a cam follower wheel 22' of the cam follower unit 22, which is mounted on the arm 10a of the drive roller holder 10. Engagement of the follower wheel 22' and control cam surface 20' is maintained by the pressure from the spring 13. The control cam is exchangeable for another of a different cam surface configuration. The control cam represented in FIGS. 1 and 2 brings about in the course of the bobbin winding a steady decrease of the circumferential velocity $V_u$ of the drive roller and bobbin by progressively allowing the friction drive wheel 8 and its holder 10 to shift to the left (as viewed in FIGS. 1 and 2) under the urging of spring 13 as control cam 20 moves upwardly relative to the follower wheel 22'.

Figure 5:
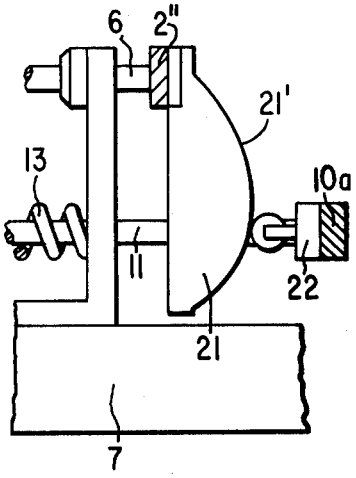
FIG. 5 is a fragmentary, front elevation of another embodiment of the cam control member usable in the embodiment of FIGS. 1 and 2.

In FIG. 5, the control cam 21 has a cam surface 21' of a different configuration, a longitudinally convex instead of longitudinally concave cam surface. This control cam brings about in the course of the bobbin winding first a progressive increase in circumferential velocity of the drive roller 8 to a maximum velocity at the crown of the cam surface 21' and then a progressive decrease in said circumferential velocity as the drive roller 8 and its driven wheel 16 or 18 are moved first to the right and later to the left (as these parts are viewed in FIG. 2) as the diameter of the winding increases and the cam control 21 correspondingly moves upwardly relative to the cam follower unit 22. In the interest of clarity it should be mentioned that the curvate form of the cam surface of the control cam depends on where the control cam is mounted, e.g., the left or to the right of the bobbin holder.

For the shifting of the drive roller holder in case of thread breakage, there is provided on the shaft 11 a core 26 with an electromagnet 27. Magnet 27 is activated by thread tension sensor 29 with dancer roll 30, connected in a circuit including amplifier 28. On the machine frame 7 there is provided as oblique plane a run-on block 14 with an upper, oblique or sloping surface 14', which serves the purpose of interrupting the drive connection between the constantly driven drive shaft 9 and the drive roller 8 by lifting the drive roller as the lower edge of the arm 10a slides across the surface 14' when the core 26 is drawn into the coil of the electromagnet 27.

Figure 3:
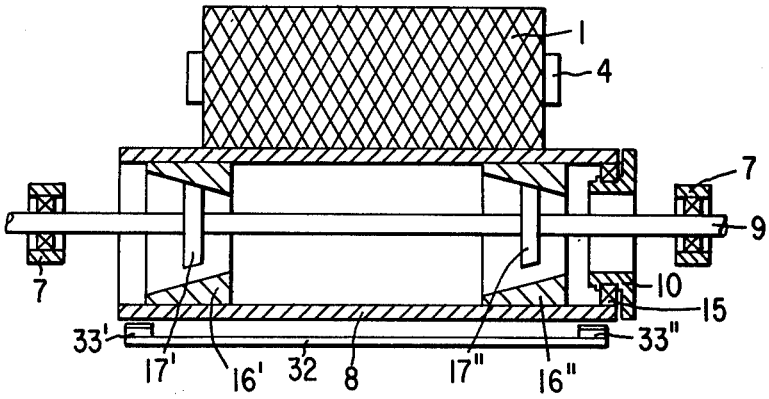
FIG. 3 is a front perspective view, partly in diametric cross section, of another embodiment of the invention utilizing two friction drive wheel pairs and bearing support for the friction drive roller at only one end thereof.

The section view of FIG. 3 shows another embodiment. This embodiment is distinguished in that the drive roller holder 10 consists of only a single swingable arm, on which there is rotatably carried the drive roller 8 in the bearing 15. The drive roller 8 has two driven, like wheels 16' and 16'', which are in frictional contact with the two, like drive wheels 17' and 17''. The advantage of this embodiment is that the two drive-wheel pairings 16', 17' and 16'', 17'' simultaneously assume a bearing function, so that the single bearing on the drive roller holder 10 can be designed without concern for structural strengths needed for what would otherwise be demanded in a cantilevered support for roller 8 by bearing 15. Through the movable frame 32, to which the brake jaws 33' and 33'' are fastened, the drive roller 8 can be raised, separated from the drive shaft and braked by moving frame 33 upwardly in the direction of the illustrated arrow. The operation of the frame 32 can take place manually by way of corresponding levers, electromagnetically, pneumatically, etc.

FIG. 4 shows a modification of a drive-wheel pairing, which can be used instead of the drive-wheel pairings shown in FIGS. 1 to 3. It consists of the frusto-conical drive wheel 19, which is secured to the drive shaft 9. The wheel 19 engages in frictional contact the transversely rounded, circular inner wall 18' of the wheel 18, which is secured to the inner wall of the drive roller.

FIGS. 6*a* and 6*b* show the sleeve-wheel pairings in reciprocal engagement at the translation ratio of 1:1, which is adjustable through axial sliding of the drive roller holder into an axial end position, to which the holder should always be shifted when there is desired a low-wear, continuous operation without variation of the translation ratio. The diameter of the smaller end of the frusto-conical inner wall of drive wheel 16' (or 16 in the case of FIGS. 1 and 2) is approximately equal to, and not greater than, the diameter of the larger end of the drive wheel 17' (or 17 in the case of FIGS. 1 and 2). Similarly, the minimum diameter of the circular opening in the wheel 18 is approximately equal to, and not greater than, the diameter of the larger end of the frusto-conical drive wheel 19.

It is thought that the invention and its numerous attendant advantages will be fully understood from the foregoing description, and it is obvious that numerous changes may be made in the form, construction and arrangement of the several parts without departing from the spirit or scope of the invention, or sacrificing any of its attendant advantages, the forms herein disclosed being preferred embodiments for the purpose of illustrating the invention.

The invention is hereby claimed as follows:

1. A winding mechanism comprising a hollow drive roller, bobbin bearing means rotatably supporting a bobbin for winding thread or the like when the bobbin or the thread wound thereon is driven in frictional contact with said drive roller, drive roller support means with said roller rotatably mounted thereon, said support means including means for shifting said roller in the axial direction of said roller and additional means allowing said drive roller to move perpendicularly to its axis of rotation, a drive shaft extending axially inside said roller, variable speed friction drive wheel means inside said roller and coupling said drive shaft and said drive roller for rotating said drive roller at stagelessly variable drive output ratios in response to axial shifting of said drive roller, said friction drive wheel means being disengageable upon movement of said roller perpendicularly to its axis of rotation, and said friction drive wheel means thereby being engageable and disengageable by movement of said drive roller perpendicularly to its axis of rotation and, when engaged, having a variable drive output ratio attained by axial shifting of said drive roller.

2. A winding mechanism as claimed in claim 1 said friction drive wheel means embodying a drive wheel inside said drive roller mounted on the drive shaft extending axially inside said roller, an annular driven wheel inside and attached to said drive roller engaging said drive wheel, and at least one of said wheels having an axially tapered driving surface.

3. A winding mechanism comprising a drive roller, drive roller support means with said roller rotatably mounted thereon, means for shifting said support means and said roller in the axial direction of said roller, friction drive wheel means for rotatably driving said roller at stagelessly variable drive output ratios in correspondence to the axially shifted position of said drive roller, bobbin bearing means rotatably supporting a bobbin for winding thread or the like when the bobbin or the thread wound thereon is driven in frictional contact with said drive roller, and control means responsive to the diameter of the winding formed on said bobbin for shifting said drive roller axially to change the drive output ratio.

4. A winding mechanism as claimed in claim 3, said control means embodying cam means operatively associated with said support means for shifting said support means and said drive roller axially as the increasing winding diameter causes movement of the bobbin axis of rotation away from said drive roller.

5. A winding mechanism as claimed in claim 4, said cam means embodying a cam member with a cam surface and being removably mounted on said bobbin bearing means and exchangeable with another cam member having a cam surface of different configuration.

6. A winding mechanism as claimed in claim 4, said cam means embodying a cam member with a curved cam surface shaped to axially shift said drive roller to provide a continuously decreasing rotational drive ratio of said driven wheel relative to said drive wheel as the diameter of the winding increases.

7. A winding mechanism as claimed in claim 4, said cam means embodying a cam member having a convexly curved cam surface with the crown of the curve in the mid-portion of said surface.

8. A winding mechanism as claimed in claim 2, said annular wheel having an axial opening therein, the radially inner surface of which is in driving engagement with the periphery of the drive wheel, and at least a portion of said drive wheel and at least a portion of said inner surface of said annular wheel having equal diameters to provide, when engaged, a 1:1 drive ratio.

9. A winding mechanism as claimed in claim 1, and means for disengaging said friction drive wheel means upon axial shifting of said drive roller to one end of the limit of its axial movement.

10. A winding mechanism as claimed in claim 1, thread monitoring means for sensing the thread running onto the bobbin, and means to move said drive roller in a direction perpendicular to its axis of rotation to disengage said friction drive wheel means in response to a thread-breakage signal from said thread monitoring means.

11. A winding mechanism as claimed in claim 2, two pair of drive wheels and two corresponding driven wheels being positioned in said hollow roller at axially spaced positions approximately symmetric relative to the longitudinal center of said drive roller and functioning as support members for said drive roller.

* * * * *